US009097014B1

(12) United States Patent
Sorkin

(10) Patent No.: US 9,097,014 B1
(45) Date of Patent: Aug. 4, 2015

(54) CARTRIDGE FOR RETAINING A SHEATHING OF A TENDON WITHIN AN ANCHOR ASSEMBLY

(71) Applicant: Felix L. Sorkin, Stafford, TX (US)

(72) Inventor: Felix L. Sorkin, Stafford, TX (US)

( * ) Notice: Subject to any disclaimer, the term of this patent is extended or adjusted under 35 U.S.C. 154(b) by 0 days.

(21) Appl. No.: 14/339,822

(22) Filed: Jul. 24, 2014

(51) Int. Cl.
*E04C 5/08* (2006.01)
*E04C 5/12* (2006.01)
*E04C 3/30* (2006.01)

(52) U.S. Cl.
CPC .... *E04C 5/12* (2013.01); *E04C 3/30* (2013.01)

(58) Field of Classification Search
CPC ..... E04C 5/12; E04C 5/122; E04C 5/08; E04C 5/127
USPC ..... 52/223.13, 223.1, 0.4, 0.5, 0.6, 0.7, 52/0.14
See application file for complete search history.

(56) References Cited

U.S. PATENT DOCUMENTS

| | | | | | |
|---|---|---|---|---|---|
| 3,844,697 | A * | 10/1974 | Edwards | 425/111 |
| 4,719,658 | A * | 1/1988 | Kriofske | 52/223.13 |
| 4,773,198 | A * | 9/1988 | Reinhardt | 52/223.13 |
| 5,630,301 | A * | 5/1997 | Sieg | 52/223.13 |
| 5,755,065 | A * | 5/1998 | Sorkin | 52/223.13 |
| 5,770,286 | A | 6/1998 | Sorkin | |
| 5,839,235 | A * | 11/1998 | Sorkin | 52/223.13 |
| 5,897,102 | A * | 4/1999 | Sorkin | 254/29 A |
| 6,098,356 | A * | 8/2000 | Sorkin | 52/223.13 |
| 6,354,596 | B1 * | 3/2002 | Rodriguez | 277/317 |
| 6,381,912 | B1 * | 5/2002 | Sorkin | 52/223.13 |
| 6,513,287 | B1 * | 2/2003 | Sorkin | 52/223.13 |
| 6,631,596 | B1 * | 10/2003 | Sorkin | 52/223.13 |
| 6,684,585 | B2 * | 2/2004 | Campbell | 52/223.13 |
| 6,761,002 | B1 * | 7/2004 | Sorkin | 52/223.13 |
| 6,817,148 | B1 * | 11/2004 | Sorkin | 52/223.13 |
| 7,424,792 | B1 * | 9/2008 | Sorkin | 52/223.13 |
| 7,726,082 | B2 * | 6/2010 | Hayes et al. | 52/223.13 |
| 7,793,473 | B2 * | 9/2010 | Sorkin | 52/223.13 |
| 7,797,894 | B1 * | 9/2010 | Sorkin | 52/223.13 |
| 7,797,895 | B1 * | 9/2010 | Sorkin | 52/223.13 |
| 7,823,345 | B1 * | 11/2010 | Sorkin | 52/223.13 |
| 7,866,009 | B1 | 1/2011 | Sorkin | |
| 7,963,078 | B1 | 6/2011 | Sorkin | |
| 8,015,774 | B1 | 9/2011 | Sorkin | |
| 8,065,845 | B1 | 11/2011 | Sorkin | |
| 2002/0007604 | A1 * | 1/2002 | Wallstein | 52/223.13 |
| 2004/0148880 | A1 * | 8/2004 | Hayes | 52/223.1 |
| 2004/0148882 | A1 * | 8/2004 | Hayes | 52/223.14 |
| 2008/0302035 | A1 * | 12/2008 | Shin | 52/223.13 |

* cited by examiner

*Primary Examiner* — Mark Wendell
(74) *Attorney, Agent, or Firm* — Egbert Law Offices, PLLC

(57) ABSTRACT

A cartridge for retaining a sheathing of a tendon within an anchor assembly has a generally tubular body with outer and inner surfaces, and at least one wedge positioned within the tubular body and against the inner surface thereof. The wedge has a surface opposite the inner wall that engages with the sheathing of the tendon. A seal is affixed to an end of the tubular body which is suitable for sealing against an anchor of the anchor assembly and an inner surface suitable for sealing against the sheathing. The inner wall of the tubular body tapers so as to narrow in inner diameter from one end thereof. The wedge has a surface bearing against the tapered portion of the inner wall of the tubular body. A protrusion extends outwardly of the tubular body so as to be received within a slot of a tubular extension of the anchor assembly.

20 Claims, 3 Drawing Sheets

CARTRIDGE FOR RETAINING A SHEATHING OF A TENDON WITHIN AN ANCHOR ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post-tension anchor systems. More particularly, the present invention the relates to anchors used in such post-tension anchor systems. More particularly, the present invention the relates to devices that retain the sheathing of a tendon within an anchor. Additionally, the present invention relates to devices that seal an end of the anchor against the sheathing of the tendon.

2. Description of Related Art Including Information Disclosed Under 37 CFR 1.97 and 37 CFR 1.98.

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile-strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual concrete members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges or threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Anchors known as "intermediate anchors" exist between the "live-end" and "dead-end" for concrete slabs having great lengths. To fix the tendon in any of these anchors, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. The tendon in a dead-end anchor can be tightened in the factory and then shipped, along with the full length of tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult because the tendon can have a considerable length and because the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the sheathing. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead-end anchorage, the end of the sheathing will tend to shrink slowly away from the dead-end anchorage.

The problem that affects many anchorage systems is the inability to effectively prevent liquid intrusion into this area of the unsheathed portion where sheathing shrinkage has occurred. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

The present inventor has developed several patented inventions with respect to the locking of sheathing in the anchor assembly. For example, U.S. Pat. No. 7,963,078, issued on Jun. 21, 2011 to the present inventor, describes a compression sheathing lock. This cap has an outer tubular portion having an inner wall and an outer wall. The cap also has an inner tubular portion having an inner wall and an outer wall. An end wall extends between the outer tubular portion and the inner tubular portion. A sheathing lock is affixed to the inner wall of the inner tubular portion. The sheathing lock has a body having locking ribs extending radially inwardly therefrom. The locking ribs extend in parallel relation to each other.

U.S. Pat. No. 7,793,473, issued on Sep. 14, 2010 to the present inventor, describes an article for engaging a sheathing of the sheathed portion of a tendon. This article has a tubular body having an inner surface and an outer surface. Fins extend radially outwardly from the outer surface. A longitudinal split extends through a wall of the tubular body and extends from the first end to the second end of the tubular body. Locking ribs extend radially inwardly from the inner surface of the tubular body. A collar is formed adjacent to the second end of the tubular body.

U.S. Pat. No. 7,797,894, issued on Sep. 21, 2010 to the present inventor, teaches an apparatus for preventing shrinkage of the sheathing of the tendon. This apparatus has an anchor body having a cavity formed in an interior thereof. A tendon extends into the cavity. A fixing element is engaged with the sheathing for fixing a position of the sheathed portion of the tendon. A pair of wedges are in engagement with the unsheathed portion of the tendon in the cavity of the anchor body. The fixing element is positioned away from the cavity of the anchor body. An encapsulation is formed over the anchor body so as to define a trumpet extending outwardly from one side of the anchor body. The clamp is engaged with the sheathed portion of the tendon within the trumpet.

U.S. Pat. No. 7,797,895, issued on Sep. 21, 2010 to the present inventor, shows a device for fixing the sheathing of an end of the tendon within an anchor body of a post-tension anchor system. The device has an anchor body having a cavity formed in an interior thereof. A tendon extends into the cavity. The tendon has a sheathing extending at least partially thereover. As such, the tendon has a sheathed portion and an unsheathed portion. A pair of wedges are in engagement with the unsheathed portion of the tendon in the cavity of the anchor body. At least one wedge member is engaged with the sheathed portion. The wedge member has a wide end at a narrow end. The wide end is adjacent to the pair of wedges.

U.S. Pat. No. 7,823,345, issued on Nov. 2, 2010 to the present inventor, describes a unitary sheathing wedge for fixing the sheathing of an end of the tendon within an anchor body. The wedge member is a unitary piece having a longitudinal split extending from an end of the piece to an opposite end of the piece. The wedge member substantially encircles an interior or an exterior of the sheathing of the sheathed portion of the tendon.

U.S. Pat. No. 7,866,009, issued on Jan. 11, 2011 to the present inventor, discloses a wedge for a sheathing lock system. This wedge has a first portion, a second portion, a third portion and a fourth portion. Each of these portions includes a channel. The first portion has a constant thickness from a first end to a second end. The second portion has a first end adjacent to the second end of the first portion and tapers from the first end of the second portion to the second end thereof. The third portion has a first end adjacent to the second end of the second portion and tapers from the first end of the third portion to a second end thereof. The fourth portion has a first end adjacent to the second end of the third portion and tapers from the first end of the first portion to the second end thereof. The channels of each of the portions include ribs.

U.S. Pat. No. 8,015,774, issued on Sep. 13, 2011 to the present inventor, shows a method for forming a sheathing retainer anchor of a post-tension anchor system. This method includes the steps of forming an anchor having a bore in which the bore has a tapered portion and a constant diameter portion, inserting an end of the tendon through the bore of the anchor so that the end of the tendon extends outwardly of the tapered portion of the bore, positioning a sheathing lock on the end of the sheathed portion on the tendon, placing a pair of wedges on the unsheathed portion of the tendon, and moving the sheathing lock and the pair of wedges into the bore of the anchor so that the sheathing lock affixes the end of the sheathed portion within the bore and so that the pair of wedges affixes the unsheathed portion within the bore.

U.S. Pat. No. 8,065,845, issued on Nov. 29, 2011 to the present inventor, describes an anchorage with a tendon sheathing lock and seal. A seal is affixed within the trumpet portion of the encapsulation so as to reside in liquid-tight sealing relation with the sheathed portion of the tendon. A pair of wedges are engaged with the unsheathed portion of the tendon. The sheathing lock is positioned adjacent to an end of the pair of wedges.

FIG. 1 herein discloses a prior art sheathing lock. In particular, FIG. 1 shows a cross-sectional view of a post-tension system that employs the sheathing lock. The system 10 has a tendon 32 extending through an anchor 14. The tendon 32 has a sheathing 38. The sheathing 38 extends only over part of the tendon 32. Thus, the tendon 32 has a sheathed portion 34 and an unsheathed portion 36. The anchor 14 has a polymeric encapsulation 16 covering an anchor member 18. The polymeric encapsulation 16 has a tubular extension 20 extending outwardly from an end 19 of the anchor member 18. The anchor member 18 is connected to the unsheathed portion 36 of the tendon 32 by wedges 30. The tubular extension 20 extends around the sheathed portion 34 of the tendon 32. The tubular extension 20 has an opening 22 formed at an end thereof opposite the anchor member 18.

A cavity 24 is formed in the interior 21 of the anchor member 18 of the anchor 14. The cavity 24 has a tapered portion 26 and a generally constant diameter portion 28. The wedges 30 are affixed to unsheathed portion 36 of the tendon 32 within the tapered portion 26 of the cavity 24. The sheathing locking means is a sheathing lock 40 positioned in the cavity 24 of the anchor member 18 of the anchor 14. More particularly, the sheathing lock 40 is positioned in the generally constant diameter portion 28 of the cavity 24. The sheathing 38 of the tendon 32 is retained in the generally constant diameter portion 28 of the cavity 24 because the sheathing lock 40 is positioned between the sheathing 38 of the tendon 32 and the generally constant diameter portion 28 of the cavity 24. Because of the position of the sheathing lock 40 it is also positioned within the polymeric encapsulation 16 of the anchor 14.

A seal 50 is positioned adjacent the end 19 of the anchor member 18 of the anchor 14. The seal 50 is substantially tubular. The seal 50 is positioned adjacent an end of the sheathing lock 40. The seal 50 is positioned along an inner wall of the tubular extension 20 of the polymeric encapsulation 16 of the anchor 14. The seal 50 can be made of a polymeric or an elastomeric material. The seal 50 has a first portion 52 and a second portion 54. The first portion 52 has an end 53 positioned adjacent the end of the sheathing lock 40. The second portion 54 extends radially inwardly from the tubular extension 20. The inner diameter of seal 50 is greater than an outer diameter of the sheathing lock 40. One end of seal 50 abuts an end of the anchor member 18 so as to form a liquid-tight seal therewith. The seal 50 is affixed in liquid-tight sealing relation with an inner wall of the tubular extension 20. The annular second portion 54 has an inner diameter residing in liquid-tight sealing relation with the sheathing 38 of tendon 32. The seal 50 is of a more pliable material than the polymeric material of encapsulation 16 and of the tubular extension 20. As such, a continuous liquid-tight seal is formed between the anchor member 18 and the inner wall of tubular extension 20 and the outer diameter of sheathing 38. The sheathing lock 40 allows the tubular extension 20 to be formed of a minimal length. Extension tubes, tape, and other seals are avoided. This serves to reduce the costs of production and labor required for assembly.

In these prior art sheathing lock systems, the actual locking of the sheathing required rather complex mechanisms. There was a desire to provide a sheathing lock system that could be easily implemented so as to lock the end of the sheathing within the dead- and anchorage of the post-tension system. Any modifications to the existing anchor, or substantial modifications to the polymeric encapsulation covering the anchor, should be avoided. In other circumstances, the actual installation required specialized pieces of equipment that would not always be available at the work site. Still further, certain of these prior art systems actually did not exert proper forces for securing the sheathing so as to be permanently locked. As such, a need developed so as to improve on these prior art systems and to provide automatic locking of the sheathing while, at the same time, preventing liquid intrusion into the interior of the sheathing or into the bore of the anchor body.

It is an object of the present invention to provide an apparatus that effectively locks a position of the sheathing over the tendon.

It is another object of the present invention to provide an apparatus that prevents liquid intrusion into either the anchor or the sheathing.

It is another object of the present invention to provide an apparatus that can be easily installed so as to effectively lock the sheathing upon the tendon.

It is still further object the present invention to provide an apparatus that locks the sheathing in an effective and efficient manner.

It is a further object of the present invention to provide an apparatus that is relatively inexpensive.

It is still further object of the present invention to provide an apparatus that is easy to install and easy to manufacture.

These and other objects and advantages of the present invention will become apparent from a reading of the attached specification and appended claims.

BRIEF SUMMARY OF THE INVENTION

The present invention is an apparatus for the locking of a sheathing within a tubular extension of an anchor assembly. The apparatus includes an anchor having a tubular extension extending therefrom, a tendon having a sheathing extending thereover, and a cartridge extending around the sheathing within the tubular extension of the anchor. A portion of the tendon and a portion of the sheathing are received within the tubular extension of the anchor. The cartridge has an inner surface engaged with the sheathing so as to retain the portion of the sheathing within the tubular extension.

In the present invention, the anchor includes an anchor body having a polymeric encapsulation formed thereover. The tubular extension is integrally formed with the polymeric encapsulation. The tubular extension has a slot formed therein. The cartridge has a protrusion received within the slot so as to fix a position of the cartridge within the tubular extension.

The cartridge has at least one wedge positioned therein. The wedge serves to engage the sheathing. The cartridge has an inner wall that has a tapered surface of therein. The wedge has a side opposite the sheathing that resides against the tapered surface of the inner wall of the cartridge. The inner wall of the cartridge has a first end adjacent to the anchor body and a second end opposite the first end. The tapered surface narrows in inner diameter from the first end toward a location between the first and second ends. The inner wall has another tapered surface widening in inner diameter from the location toward the second end of the cartridge. The at least one wedge includes a first wedge positioned on one side of the sheathing and a second wedge positioned on opposite side of the sheathing.

The cartridge has a generally tubular body. The protrusion is positioned between a first end and a second end of the generally tubular body. The protrusion has an angled surface extending outwardly of the generally tubular body and a transverse surface extending outwardly of the generally tubular body. The transverse surface serves to abut a wall of the slot of the tubular extension.

The anchor body has a surface adjacent to the tubular extension. The cartridge includes a seal that is affixed to an end thereof. The seal is in contact with the surface of the anchor body so as to provide a liquid-tight seal therewith. The seal also has an inner annular surface that is in generally liquid-tight engagement with the outer surface of the sheathing.

The present invention is also a cartridge for retaining a sheathing of a tendon within an anchor member. This cartridge includes a generally tubular body having an outer surface and an inner surface, at least one wedge positioned within the generally tubular body against the inner surface. The wedge has a surface opposite the inner wall that can engage with the sheathing of the tendon.

The cartridge includes a protrusion extending outwardly of the outer wall of the generally tubular body. The protrusion is suitable for receipt within the anchor assembly. The inner wall of the tubular body has a first portion tapering so as to narrow in inner diameter from a first end thereof to a location between the first end and the second end thereof. The wedge has another surface bearing against the first tapered portion of the inner wall of the generally tubular body. The surface of the wedge has teeth formed thereon. These teeth are engageable with the sheathing. A seal is affixed to the first end of the tubular body. The seal has an end surface suitable for sealing against an anchor body of the anchor assembly and an inner annular surface suitable for sealing against the sheathing. The wedge is slidably positioned against the inner wall of the tubular body.

The present invention is also a process for retaining a sheathing of the tendon within an anchor assembly. The anchor assembly will have a tubular extension extending outwardly from an anchor body. The process includes the steps of: (1) forming a cartridge having at least one wedge positioned therein; (2) placing the cartridge over the sheathing of the tendon in a location away from the tubular extension; (3) sliding the cartridge into the tubular extension; (4) engaging the wedge within the sheathing; and (5) fixing a position of the cartridge within the tubular extension.

In the process of the present invention, the tubular extension has a slot formed into a wall thereof. The step of forming includes forming a protrusion extending outwardly of the cartridge. The step of fixing includes sliding the cartridge into the tubular extension until a protrusion is received by the slot of the tubular extension.

The step of forming includes affixing a seal onto an end of the cartridge. The process further includes bearing the seal against a surface of the anchor body when the position of the cartridge is fixed. The wedge can slide along an inner wall of the cartridge until a surface of the wedge opposite the inner wall of the cartridge is engaged with a surface of the sheathing.

This foregoing Section is intended to describe, with particularity, the preferred embodiment of the present invention. It is understood that modifications to this preferred embodiment can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 2:
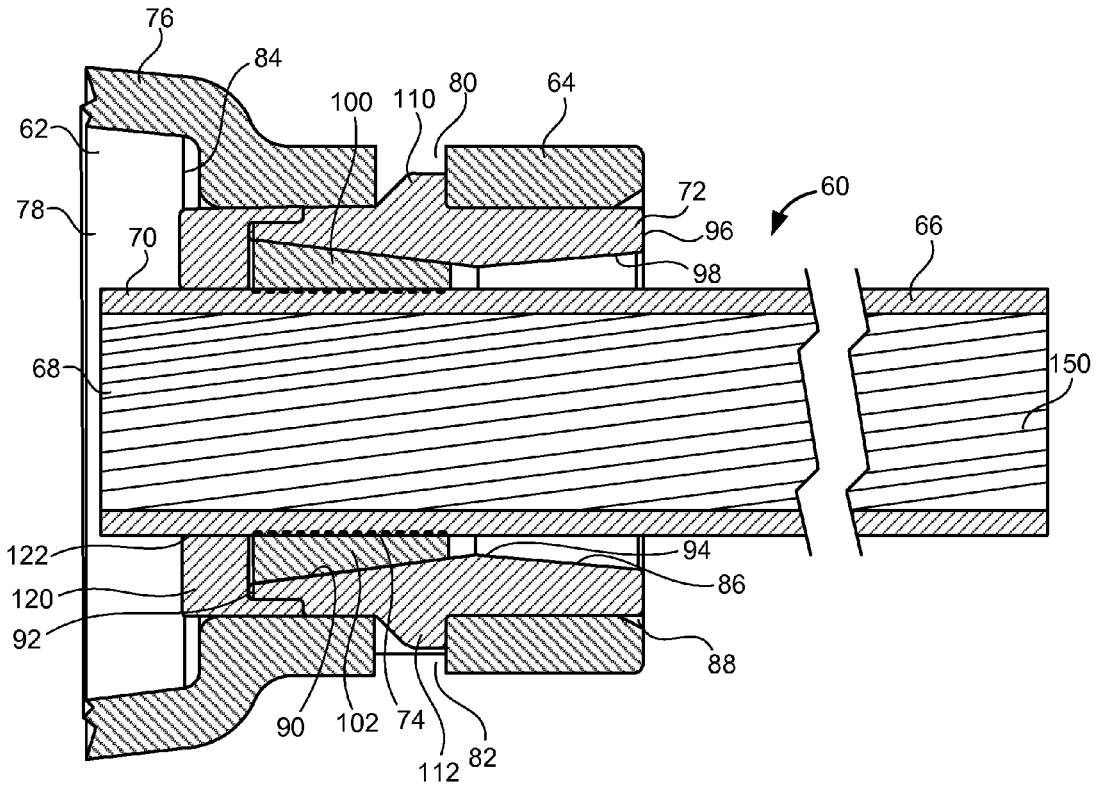
FIG. 2 is a cross-sectional view showing the sheathing lock apparatus of the present invention.

Referring to FIG. 2, there is shown the apparatus 60 in accordance with the teachings of the present invention. The apparatus 60 includes an anchor 62 having a tubular extension 64 extending therefrom. The apparatus has a tendon 150 having a sheathing 66 extending thereover. A portion 68 of the tendon 150 and a portion 70 of the sheathing 66 are received within the tubular extension 64 of the anchor 62. A cartridge 72 is illustrated as extending around the portion 70 of the sheathing 66 within the tubular extension 64. The cartridge 72 has an inner surface 74 that is engaged with the portion 70 of the sheathing 66 so as to retain the portion 70 within the tubular extension 64.

Figure 1:
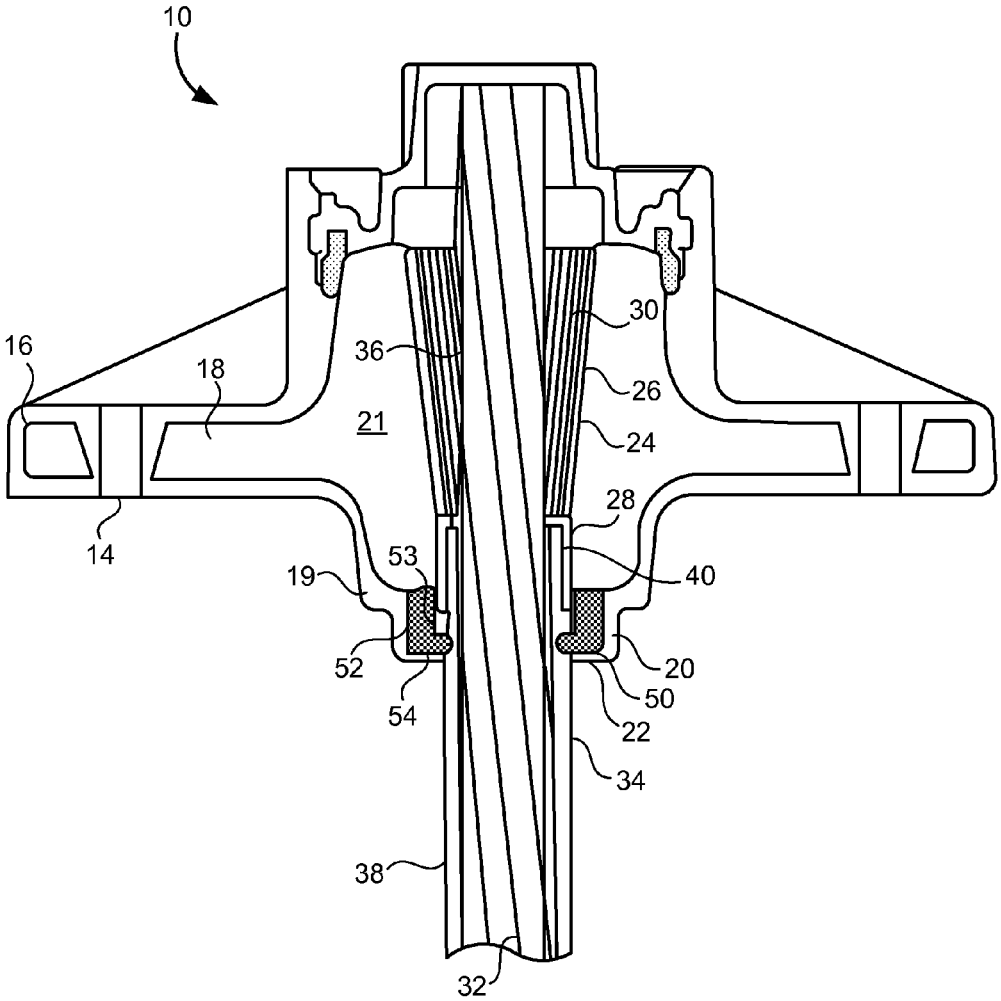
FIG. 1 PRIOR ART
FIG. 1 is a cross-sectional view showing a prior art sheathing lock apparatus.

The anchor 62 has a configuration similar to that shown in FIG. 1. In particular, there is a polymeric encapsulation 76 that is formed over the steel anchor body 78. The tubular extension 64 is part of this polymeric encapsulation 76 and is integral therewith. As such, the tubular extension 64 will extend the distance away from the anchor body 78. The tubular extension 64 has a slot 80 formed therein. In particular, the tubular extension 64 will include another slot 82 formed on an opposite side thereof. The anchor body 78 has a surface 84 adjacent to the tubular extension 64. As will be described hereinafter, the cartridge 72 will include a seal which bears against the surface 84 of the anchor body 78.

The cartridge 72 has an inner wall 86 formed therein. This inner wall 86 will define an interior passageway of the cartridge 72. The cartridge 72 will have the inner wall 86 and an outer wall 88. The inner surface 86 includes a tapered surface 90. The tapered surface 90 narrows the interior diameter of the interior passageway of the cartridge 72 from a first end 92 of the cartridge 72 toward a location 94 located between the first end 92 and the second end 96. The inner wall 86 also has another tapered surface 98 which widens in interior diameter from the location 94 toward the second end 96.

The cartridge 72 importantly includes a first wedge 100 and a second wedge 102. Each of the wedges 100 and 102 has a surface which resides against the tapered surface 90 of the cartridge 72. Each of the wedges 100 and 102 will include another surface which bears against or is engaged with the outer surface of the portion 70 of the sheathing 66 located within the tubular extension 64. As can be seen in FIG. 2, teeth are formed on the surfaces of the wedges 100 and 102 so as to engage with the outer surface of portion 70 of the sheathing 66. As such, these wedges 100 and 102 serve to retain the sheathing 66 within the interior passageway of the cartridge 72 and within the tubular extension 64. Since the surface 90 allows the wedges 100 and 102 to slide therealong, the wedges 100 and 102 can be moved toward the left of the illustration of FIG. 2 for the purposes of installation of the cartridge 72. After the cartridge 72 is installed, the wedges 100 and 102 will move toward the constricted area at location 94 so as to achieve the proper wedge effect. It is important to realize that relatively minimal forces (less than 100 p.s.i.) will be required in order to retain the portion 70 of the sheathing 66 within the tubular extension 64. As such, the hard polymeric material used for the formation of the tubular body of the cartridge 72 will be sufficient such that the wedges 100 and 102 will achieve the proper retaining and locking effect.

The tapered portion of inner wall 86 on the interior of the cartridge 72 creates a funnel effect. As such, this facilitates the ability to introduce the end of the tendon 150 into and through the cartridge 72. As the tendon 150 is introduced through the interior passageway of the cartridge 72, it will displace the wedges 100 and 102 along the tapered surface 90. Once installed, the natural retraction of the sheathing 66 will cause the wedges 100 and 102 to move inwardly toward the location 94 in order to achieve the requisite retention effect.

In FIG. 2, it can further be seen that the tubular body of the cartridge 72 includes a first protrusion 110 and a second protrusion 112 extending outwardly therefrom. Each of these protrusions 100 and 112 is received within the respective slots 80 and 82 of the tubular extension 64. Each of the protrusions 110 and 112 includes an angled surface extending outwardly from the outer surface 88 of the cartridge 72 and a transverse surface extending in transverse relationship to the longitudinal axis of the cartridge 72. As such, the angled surface can facilitate the ability to slide the cartridge 72 through the interior of the tubular extension 64. Once the shoulder defined by the transverse surface passes into the slots 80 and 82, the cartridge 72 can be rigidly retained therein. As such, this arrangement of protrusions 110 and 112 and slots 80 and 82 serves to secure the cartridge 72 in its desired position and to lock the cartridge 72 into this desired position.

Importantly, in FIG. 2, a seal 120 is affixed to the tubular body of the cartridge 72. The seal 120 can be made of a rubber material, an elastomeric material, or a polymeric material. The seal 120 is relatively soft. Once the protrusions 110 and 112 are inserted into the slots 80 and 82, the cartridge 72 will be in a position whereby the end of the seal 120 will bear against the facing surface 84 of the anchor body 78. As such, a liquid-tight seal is established in this area. Additionally, the squeezing of the seal 120 after the installation will urge the inner wall 122 of the seal 120 toward the outer surface of the portion 70 of the sheathing 66. As such, another liquid-tight seal is established between this inner surface 122 and the outer surface of the sheathing 66. Once again, this provides a dual seal for the purposes of preventing liquid intrusion either into the cavity of the anchor body 78 or into the interior of the sheathing 66.

Figure 3:
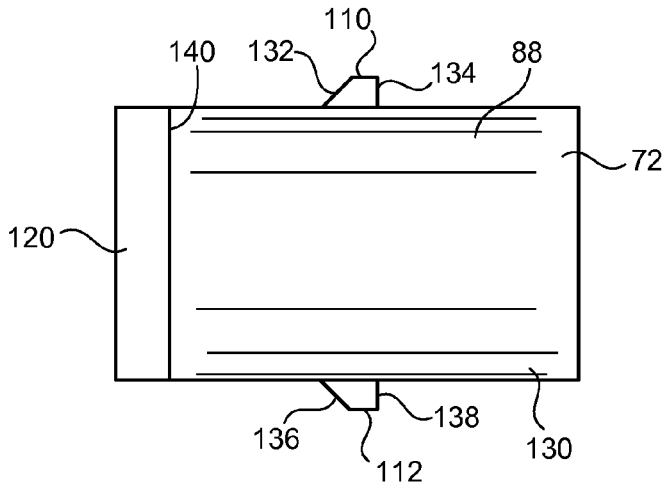
FIG. 3 is a side elevational view showing the sheathing lock cartridge in accordance with the preferred embodiment of the present invention.

FIG. 3 shows a side view of the cartridge 72. It can be seen that the cartridge 72 includes a tubular body 130 having an outer surface 88. The protrusion 110 extends outwardly on one side of the tubular body 130 and the other protrusion 112 extends outwardly on an opposite side of the tubular body 130. The protrusion 110 includes the angled surface 132 and the transverse surface 134. The protrusion 112 includes the angled surface 136 and the transverse surface 138. The angled surfaces 132 and 136 will extend at an acute angle with respect to the longitudinal axis of the cartridge 72. The transverse surfaces 134 and 138 extend radially outwardly in transverse relationship to the longitudinal axis of the cartridge 72. The seal 120 is affixed to the end 140 of the tubular body 130. The seal 120 has an outer diameter generally matching the outer diameter of the tubular body 130.

Figure 4:
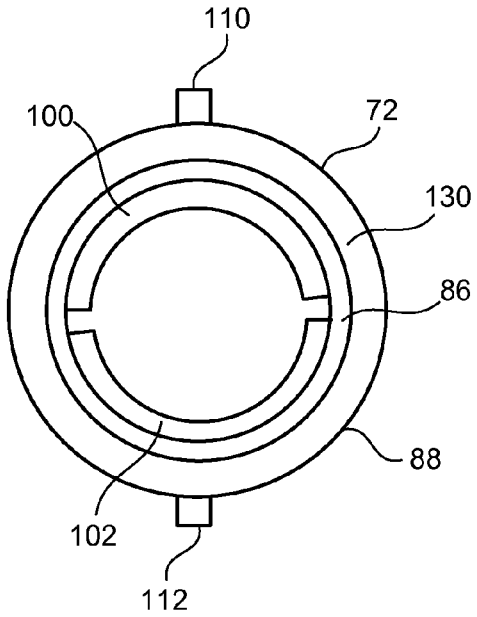
FIG. 4 is an end view showing the sheathing lock cartridge in accordance with the present invention.

FIG. 4 is an end view of the cartridge 72. It can be seen that the protrusions 110 and 112 extend radially outwardly of the outer surface 88 of the cartridge 72. FIG. 4 further shows the tapered surface of inner wall 86 on the interior of the tubular body 130. The pair of wedges 100 and 102 are illustrated as located within the interior of the tubular body 130. These wedges 110 and 112 can be slightly spaced from one another while substantially encircling the sheathing 66. In other embodiments, a larger number of wedges could also be used.

Figure 5:
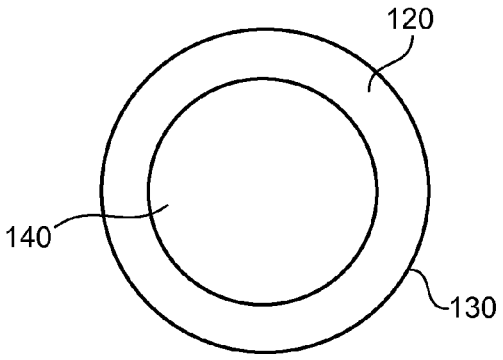
FIG. 5 is an opposite end view of the sheathing lock cartridge in accordance with the present invention.

FIG. 5 shows the seal 120 located at the end of the tubular body 130. Seal 120 includes an annular opening 140. Annular opening 140 provides an area whereby the end of the tendon 150 can extend therethrough and into the cavity of the anchor body.

The foregoing disclosure and description of the invention is illustrative and explanatory thereof. Various changes in the details of the illustrated construction or in the steps of the described method can be made within the scope of the present invention without departing from the true spirit of the invention. The present invention should only be limited by the following claims and their legal equivalents.

I claim:

1. An apparatus comprising:

an anchor having a tubular extension extending therefrom;

a tendon having a sheathing extending thereover, a portion of said tendon and a portion of said sheathing received in said tubular extension of said anchor; and a cartridge extending around said sheathing within said tubular extension of said anchor, said cartridge having an inner surface engaged with said sheathing so as to retain said portion of said sheathing within said tubular extension, said cartridge having a first wedge positioned therein, said first wedge engaging said sheathing, said cartridge having an inner wall that has a tapered surface therein, said first wedge having a side opposite said sheathing that resides against said tapered surface.

2. The apparatus of claim 1, said anchor having a polymeric encapsulation formed thereon, said tubular extension integrally formed with said polymeric encapsulation.

3. The apparatus of claim 1, said tubular extension having a slot formed therein, said cartridge having a protrusion received in said slot so as to fix a position of said cartridge within said tubular extension.

4. The apparatus of claim 3, said cartridge having a generally tubular body, said protrusion positioned between a first end and a second end of said generally tubular body, said protrusion having an angled surface relative to a longitudinal axis of said cartridge extending outwardly from said generally tubular body and a transverse surface relative to a longitudinal axis of said cartridge extending outwardly from said generally tubular body.

5. The apparatus of claim 1, wherein said cartridge has an interior passageway having an interior diameter and said inner wall of said cartridge having a first end adjacent said anchor and a second end opposite said first end, said tapered surface narrowing the interior diameter from said first end toward a location between said first and second ends, said inner wall having another tapered surface widening the interior diameter from said location toward said second end of said cartridge.

6. The apparatus of claim 1, said first wedge positioned on one side of said sheathing and further comprising a second wedge positioned on an opposite side of said sheathing engaging said sheathing, said second wedge having a side opposite said sheating that resides against said tapered surface.

7. The apparatus of claim 6, wherein the wedges substantially encircle said sheathing.

8. The apparatus of claim 1, said anchor having a surface adjacent said tubular extension, said cartridge having a seal affixed to an end thereof, said seal being in contact with said surface of said anchor.

9. A cartridge for retaining a sheathing of a tendon within an anchor, the cartridge comprising:

a generally tubular body having an outer surface wall and an inner wall, said generally tubular body having a first end and a second end; and a wedge positioned within said generally tubular body, the wedge having a surface opposite said inner wall adapted to engage with the sheathing of the tendon, said inner wall of said generally tubular body having a first tapered portion tapering so as to narrow in diameter from said first end to a location between said first end and said second end, the wedge having another surface bearing against said first tapered portion of said inner wall of said generally tubular body.

10. The cartridge of claim 9, further comprising:

a protrusion extending outwardly of said outer wall of said generally tubular body, said protrusion adapted for receipt within the anchor.

11. The cartridge of claim 10, said protrusion having an angled surface extending outwardly of said generally tubular body and a transverse surface extending outwardly of said generally tubular body.

12. The cartridge of claim 9, said surface opposite said inner wall of said wedge having teeth formed thereon, said teeth engageable with the sheathing.

13. The cartridge of claim 9, the wedge being slidably positioned against said inner wall of said generally tubular body.

14. A cartridge for retaining a sheathing of a tendon within an anchor, the cartridge comprising:

a generally tubular body having an outer wall and an inner wall, said generally tubular body having a first end and a second end;

a wedge positioned within said generally tubular body, the wedge having a surface opposite said inner wall adapted to engage with the sheathing of the tendon; and a seal affixed to said first end of said generally tubular body, said seal having an end surface adapted to seal against an anchor of the anchor assembly and an inner surface adapted to seal against the sheathing.

15. The cartridge of claim 14, wherein said seal is comprised of a rubber material, an elastomeric material or a polymeric material.

16. The cartridge of claim 14, wherein the inner wall has teeth formed thereon.

17. A process for retaining a sheathing of a tendon within an anchor, the anchor having a tubular extension extending from an anchor body, the process comprising:

forming a cartridge having a wedge positioned therein;

affixing a seal onto an end of said cartridge, said seal having an inner wall;

sliding said cartridge into the tubular extension;

engaging the wedge with the sheathing, the sheathing having an outer surface;

fixing a position of said cartridge within the tubular extension; and bearing said seal against a facing surface of said anchor body when the position of said cartridge is fixed.

18. The process of claim 17, the tubular extension having a slot formed into a wall thereof, the step of forming comprising forming a protrusion extending outwardly of said cartridge, the step of fixing comprising:

sliding said cartridge into said tubular extension until said protrusion is received by the slot of the tubular extension.

19. The process of claim 17, the step of engaging comprising:

sliding the wedge along an inner wall of said cartridge until a surface of the wedge opposite said inner wall of said cartridge is engaged with a surface of the sheathing.

20. The process of claim 17, further comprising:

positioning said sheathing within said seal such that the outer surface of said sheathing and the inner wall of said sear are engaged.

* * * * *